United States Patent [19]

Castelli

[11] Patent Number: 4,511,036

[45] **Date of Patent: * Apr. 16, 1985**

[54] TIDY ELEMENT PROVIDED WITH SEVERAL COMPARTMENTS

[75] Inventor: Renato Castelli, Ghent, Belgium

[73] Assignee: Samsonite Corporation, Denver, Colo.

[ * ] Notice: The portion of the term of this patent subsequent to Sep. 4, 1996 has been disclaimed.

[21] Appl. No.: 416,477

[22] Filed: Sep. 10, 1982

Related U.S. Application Data

[63] Continuation-in-part of Ser. No. 213,736, Dec. 5, 1980, abandoned.

[30] Foreign Application Priority Data

Dec. 18, 1979 [BE] Belgium ..... 880684

[51] Int. Cl.[3] ..... B65D 43/14; B65D 51/04

[52] U.S. Cl. ..... 206/371; 206/214; 206/224; 220/306

[58] Field of Search ..... 206/214, 224, 371, 1.7, 206/1.8, 425, 450; 150/52 B; 220/255, 306

[56] References Cited

U.S. PATENT DOCUMENTS

| | | | |
|---|---|---|---|
| 292,270 | 1/1884 | Werner | 206/214 |
| 597,481 | 1/1898 | Graham | 150/52 B |
| 1,787,791 | 1/1931 | May | 206/214 |
| 2,088,953 | 8/1937 | Greer | 206/214 |
| 2,228,493 | 1/1941 | Will | 206/214 |
| 3,126,891 | 3/1964 | Caputi | 206/214 |
| 3,199,643 | 8/1965 | Korchmar | 190/16 |
| 3,360,116 | 12/1967 | Somers et al. | 206/45.13 |
| 4,166,547 | 9/1979 | Castelli | 220/22 |
| 4,308,951 | 1/1982 | Walker, Jr. | 206/214 |
| 4,318,471 | 3/1982 | Hutton | 206/214 |

FOREIGN PATENT DOCUMENTS

| | | | |
|---|---|---|---|
| 76808 | 9/1948 | Czechoslovakia | 206/214 |
| 2443846 | 4/1975 | Fed. Rep. of Germany | 206/371 |
| 2525004 | 12/1976 | Fed. Rep. of Germany | 206/224 |
| 1152024 | 8/1957 | France | 206/820 |

*Primary Examiner*—William T. Dixson, Jr.
*Assistant Examiner*—Brenda J. Ehrhardt
*Attorney, Agent, or Firm*—Robert E. Burns; Emmanuel J. Lobato; Bruce L. Adams

[57] ABSTRACT

The tidy element, that is designed to be fixed at the inner face of the back wall of the lid of a case, such as an attache-case, is formed of several compartments, generally three compartments, two of which are provided with an elastic hooking strip. The lid of one of the two compartments provided with a lid bears at the inner face another small lid that opens in the opposite sense. The lid of the other of these two compartments bears, at the inner face, parallel and aligned small brackets that form rows of racks designed to support items such as pencils, pens and the like.

8 Claims, 25 Drawing Figures

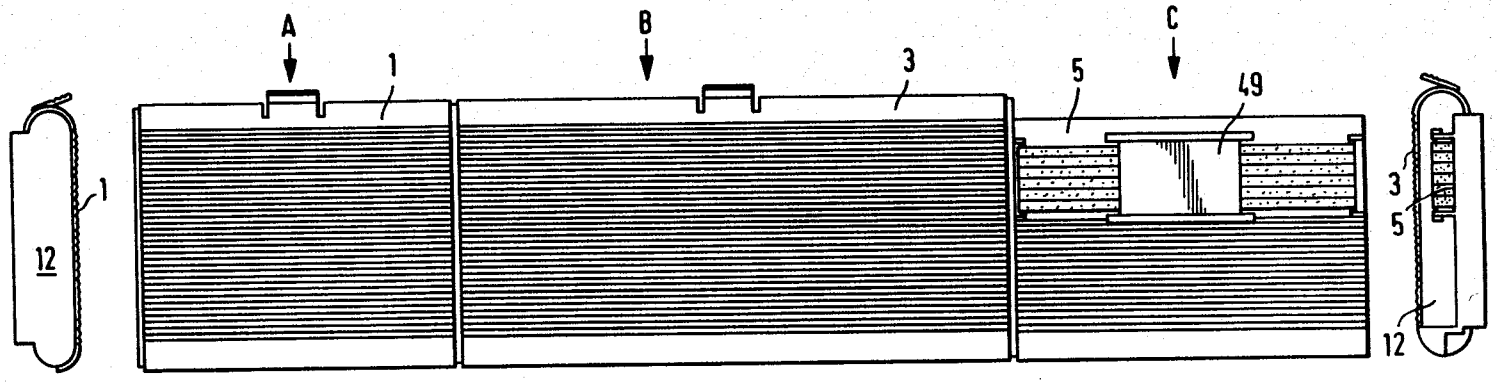
Fig. 1
Fig. 2
Fig. 3
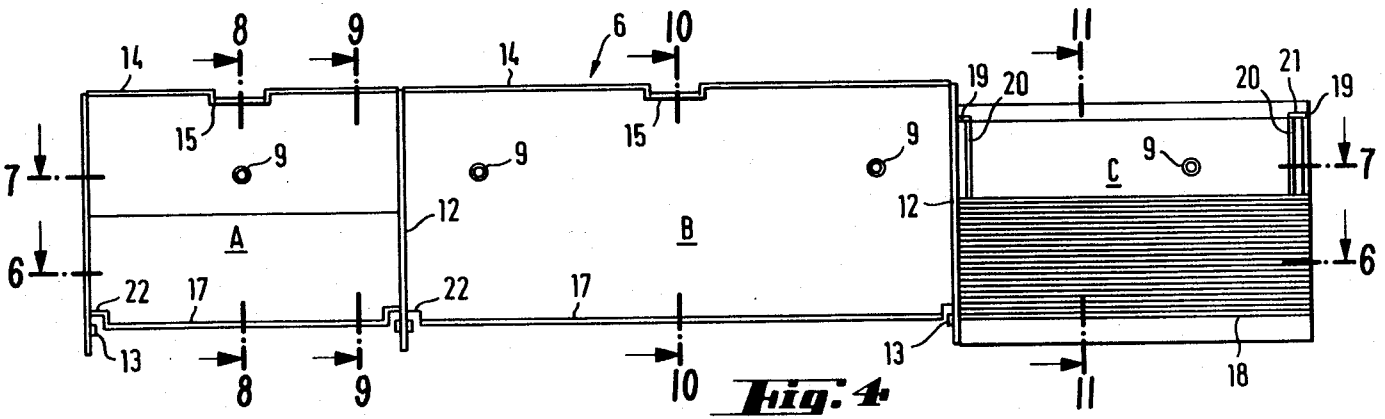
Fig. 4

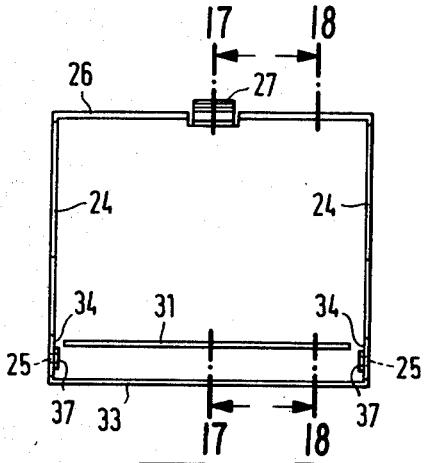
Fig. 15
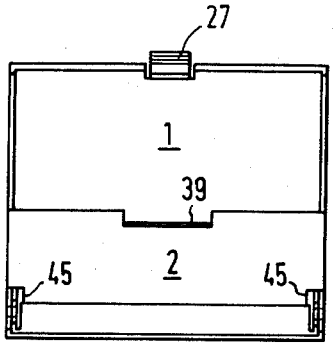
Fig. 16
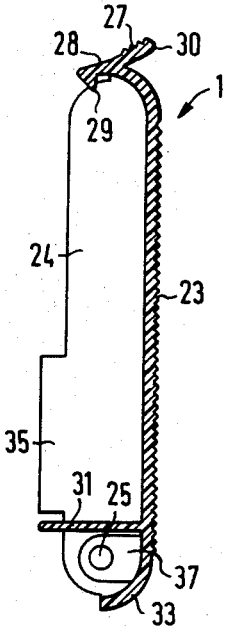
Fig. 17
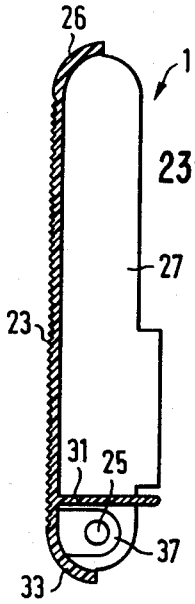
Fig. 18
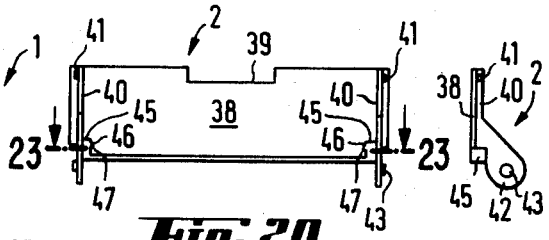
Fig. 20
Fig. 21
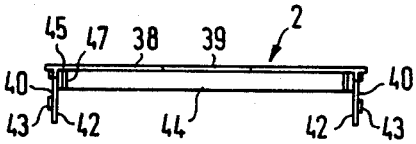
Fig. 22
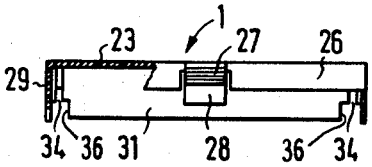
Fig. 19
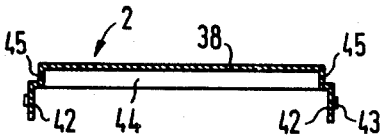
Fig. 23

TIDY ELEMENT PROVIDED WITH SEVERAL COMPARTMENTS

REFERENCE TO PRIOR APPLICATION

This application is a continuation-in-part of application Ser. No. 213,736 filed Dec. 5, 1980 now abandoned.

BACKGROUND OF THE INVENTION

The present invention relates to a tidy element divided into several compartments suitable for keeping small items that are of common use and are taken away by business men and/or students, for example office requisites, such as writing instruments, drawing instruments and mathematical instruments, pencils, fountain-pens, ball-point pens and the like, notebooks, notepaper, postage-stamps, small documents to be distributed or to be kept, such as visiting cards, small working items, such as pocket calculators, pocket diaries, magnetic recorders in miniature, as well as small-sized items to be taken away that could easily go astray in a tidy element of large volume. Said tidy element is specially designed to be fitted inside the back of a case of the attachecase type and to be secured to the back of the case, i.e. to the inner face of the opening lid of such a case, the tidy element being essentially characterized in that it is designed in such a way as to allow to find easily very small items contained therein and in that, although it is of a little thickness, it may contain rather numberous articles that will be easily found again to be used, the lids with which certain compartments are provided being notwithstanding easy to close and to maintain in the closed position.

SUMMARY OF THE INVENTION

To this end, the tidy element in accordance with the present invention, that is substantially flat and planar and that is provided with several compartments, generally three compartments, one of which is generally not provided with a lid and that is entirely made by moulding of plastics, more particularly of ABS or polyamide, but an elastic holding strip with which the compartment without lid is provided, is characterized in that it is formed of the different parts, entirely finished by moulding, that are mentioned hereinafter:

A first part, covering the whole length and the whole height of a tidy element, said first part being designed to be mounted at the inner face of the back wall of a case lid and to be fixed flat to said inner face of the back wall of the case lid, the first part being made in one piece and forming the totality of the plane bottom, eventually in parallel planes and plane lateral portions for partitioning, as well as longitudinal portions extending substantially on a rectilinear line, the bottom incorporating on the outer face a base or bearing member in one and the same plane ensuring a perfect seating of the tidy element on the inner face of the wall of the case, a bearing member that has sockets increasing the depth of the holes made in the bottom for elements attaching the base to the back wall of the case, said lateral partitioning portions, provided at least for the compartments that are provided with a lid, bearing on the side turned toward the lid and at the lower end a small perpendicular trunnion or pivot, and the longitudinal upper portions, that are provided at least for the compartments designed to receive a lid, presenting in the middle of their length a small parallel face that is offset downward and is provided with a small hooking rim, and the rectilinear longitudinal lower portions forming either the whole lower side of a compartment that is not provided with a lid, or part of the lower side of a compartment that is provided with a lid and, in this case, being designed to form a stop that limits the angle of opening of the lids and is located in alignment with the axis of the trunions or pivots;

secondly, lids for all the compartments but one, that form by themselves on each side a limiting portion in such a way as to constitute a case, each lid incorporating, beside a usual portion forming a bottom on the one hand two lateral plane portions designed to be moved near the lateral partitioning partitioning portions of the bottom and parallel to said lateral partitioning portions, said lateral portions of the lid being provided, on a level with the trunnion or pivot of the lateral partitioning portions, with a hole which the corresponding trunnion or pivot enters, and on the other hand, longitudinal upper portions completing the longitudinal upper portions of the bottom for forming with the upper side of the compartment, said longitudinal portion but presenting in the middle of its length a partial cleared portion incorporating, on the one hand, a plane forward portion ending by a downward lug, to be hooked on the corresponding hooking rim of the plane faces of the longitudinal upper portions of the bottom, and, on the other hand, a plane recess serving as a gripping means for opening the lid, the latter incorporating also two rectilinear longitudinal lower portions one of which is on a level with or above the rotating axis of the lid formed by the trunnion or pivot and the corresponding hole and forming by itself or with the corresponding portions of the bottom the lower portion of the compartment, and the other, beneath the preceding one, that is the lowermost portion of the tidy element and that will butt against the longitudinal lower portions of the bottom when the lid will be opened, and that will so limit the opening of the lid.

Preferentially, the tidy element is divided into three compartments, two of which are provided with a lid and one of these two compartments, having a length slightly exceeding the common length of a pencil, of a fountain-pen or of a ball-point pen, i.e. approximately 18 cm., being provided with a lid bearing several parallel inner brackets inclined upwardly that form several rows of racks, the second of these two compartments, having a shorter length, approximately of 10 cm., being provided with a lid that bears innerly, on a portion of its length another small lid that closes automatically and that covers more or less the half of the height of the first lid from the base line of this one. The third compartment, the length of which is also of approximately 10 cm., is not provided with a lid and the corresponding portion of the bottom is arranged in such a way as to be able to be provided with an elastic strip fixed thereto, under which a small flat item, for example a pocket calculator or a magnetic recorder in miniature may easily be slid.

BRIEF DESCRIPTION OF THE DRAWINGS

To provide a clearer understanding of the present invention and to show the characteristics and the benefits thereof, a description is given below with reference to the accompanying drawings illustrating, by way of non-limitative example only, a tidy element made in accordance with the invention.

In said drawings,

FIG. 1 is a general front plan view of the tidy element in accordance with the present invention, completely mounted;

FIG. 2 is an end view of the tidy element shown in FIG. 1, seen from the left of this figure;

FIG. 3 is an end view of the tidy element shown in FIG. 1, seen from the right of this Figure;

FIG. 4 is a general front plan view of the unique bottom or rear part of the tidy element in accordance with the present invention;

FIG. 15 is a general back plan view of the lid of the small lateral compartment (without the small inner lid thereof);

FIG. 16 is a general back plan view of the lid of the small lateral compartment (with the small inner lid thereof in place);

FIG. 17 is a cross-sectional side view taken on the line 17—17 of FIG. 15;

FIG. 18 is a cross-sectional side view taken on the line 18—18 of the FIG. 15;

FIG. 19 is a view from the top of FIG. 15, that shows the lid of the small lateral compartment of the tidy element in accordance with the present invention partially in section;

FIG. 20 is a general front plan view of the small lid (from the rear of FIG. 16);

FIG. 21 is a side view from the end of FIG. 20;

FIG. 22 is a view from the top of FIG. 20;

FIG. 23 is a cross-sectional top view taken on the line 23—23 of FIG. 20;

DESCRIPTION OF THE PREFERRED EMBODIMENT

Figure 5:
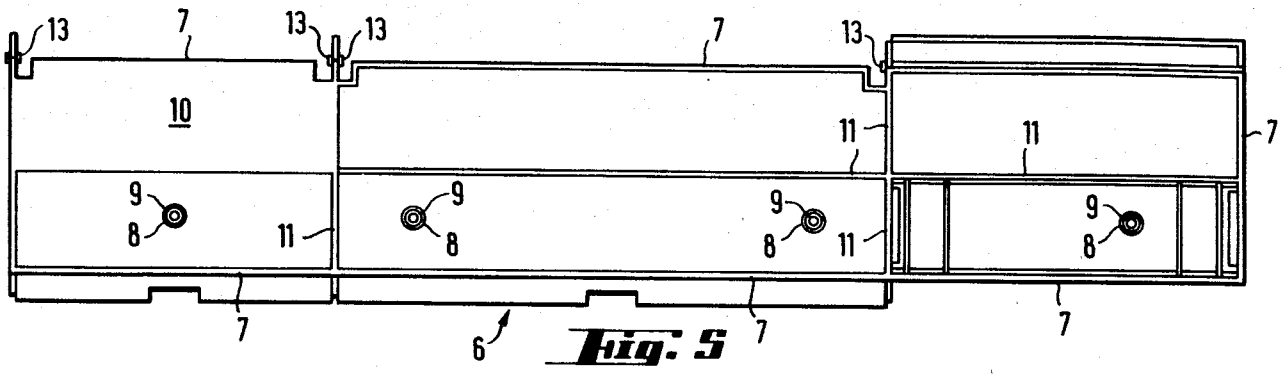
FIG. 5 is a general back plan view of the unique bottom or rear part of the tidy element in accordance with the present invention.
Figure 6:
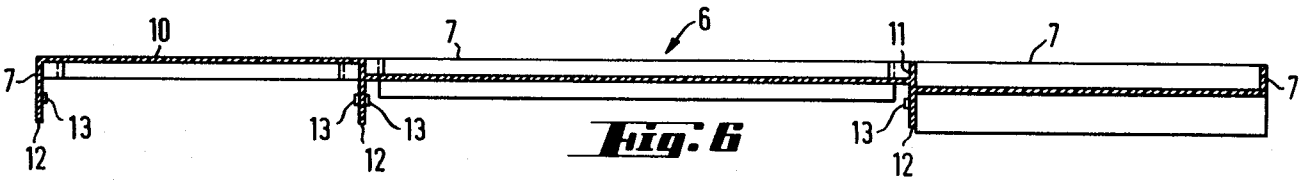
FIG. 6 is a longitudinal cross-sectional view, from above, taken on the line 6—6 of the FIG. 4.
Figure 7:
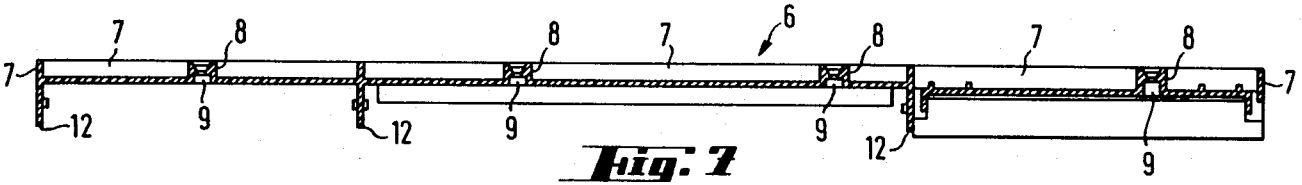
FIG. 7 is a longitudinal cross-sectional view, from above, taken on the line 7—7 of the FIG. 4.
Figure 8:
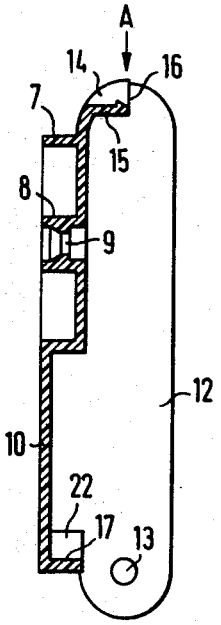
FIG. 8 is a cross-sectional side view taken on the line 8—8 of FIG. 4.
Figure 9:
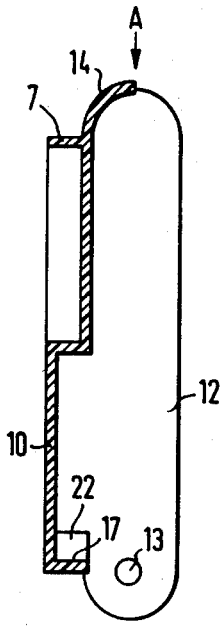
FIG. 9 is a cross-sectional side view taken on the line 9—9 of FIG. 4.
Figure 10:
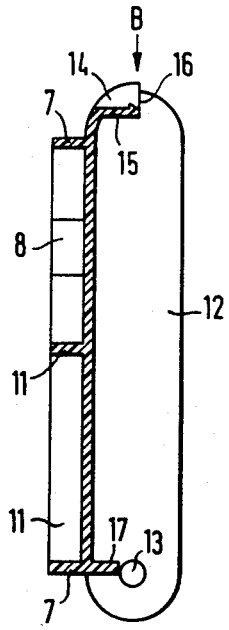
FIG. 10 is a cross-sectional side view taken on the line 10—10 of FIG. 4.

The various Figures of the drawings illustrate a tidy element in accordance with the present invention incorporating three compartments indicated by the reference letters A, B, C, that are each arranged in a different way, the first one, compartment A, that is of a reduced width, being provided with a lid indicated by the reference numeral 1, that is itself provided with an inner lid indicated by the reference numberal 2 (see FIG. 16), being designed to receive very small items; the second one, compartment B, that is wider than compartment A, being provided with a lid indicated by the reference numberal 3, that bears parallel inner brackets 4 forming rows of racks (FIG. 12) for holding pencils, fountain-pens, ball-point pens and other elongated articles; the third one, compartment C, being provided with an elastic strip indicated by the reference numeral 5, under which items such as a pocket calculator, a miniature magnetic recorder, or the like may be slid and maintained.

Referring to FIGS. 4 to 11 and more particularly to FIG. 5, it will be seen how the outer face of the main bottom part indicated by the reference numeral 6 of the tidy element part to be fixed at the inner face of the back wall of the lid of a case (not shown) is arranged, said main bottom part 6 being provided with a base or bearing member in one and the same plane, that forms a complete frame indicated by the reference numeral 7, not only designed to provide for a suitable bearing for the tidy element in the back of the case, but also necessary to allow the provision of outer or prominent sockets at the holes indicated by the reference numeral 9 designed to receive fastening studs (not shown) as well as the provision of a recess indicated by the reference numeral 10 out of the general plane of the bottom main part 6 with a height corresponding to the height of the small lid 2, the frame 7 is also provided with transverse and longitudinal ribs indicated by the reference numeral 11, that confer more rigidity to the bottom main part 6.

Figure 11:
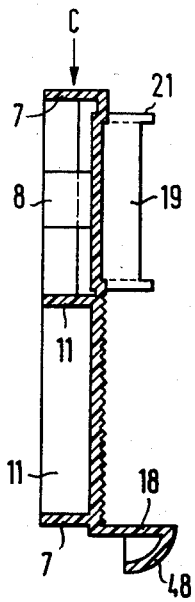
FIG. 11 is a cross-sectional side view taken on the line 11—11 of FIG. 4.

FIGS. 4 and 6 to 11 illustrate more particularly the arrangement of the inner face (that will receive the lids 1 and 3) of the main bottom part 6, that also comprises lateral partitions indicated by the reference numeral 12 defining the compartments A and B being provided at their inner side and in their lower part with a trunnion or pivot indicated by the reference numeral 13, as well as partially the longitudinal top portions indicated by the reference numeral 14 of the compartments A and B that form in the middle of their length a small plane face indicated by the reference numeral 15, downward offset, with a small upward hooking rim indicated by the reference numeral 16, and also, for a part, the longitudinal lower portions indicated by the reference numeral 17 of the compartments A and B that serve as stops when the lids 1 and 3 are opened, and finally the whole longitudinal lower portion 18 indicated by the reference numeral 18 of the compartment C. On the other hand, FIG. 4 also represents the holes 9 that are designed to receive the fastening studs (not shown) and that are made in such a way as to countersink the head of the studs, slots indicated by the reference numeral 19, in the compartment C for passing the elastic strip 5, and also short transverse rims indicated by the reference numeral 20 for maintaining said strip 5 slightly distant from the main bottom part 6 and short longitudinal rims 21, that are however a little longer, for guiding said strip 5 (FIG. 11).

Referring to FIG. 4, it will be seen that the longitudinal lower portions 17 form at their ends off set portions indicated by the reference numeral 22, that allow to place the lids 1 and 3.

Figure 14:
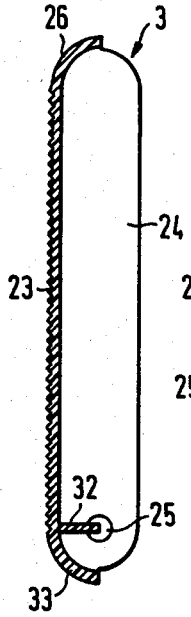
FIG. 14 is a cross-sectional side view taken on the line 14—14 of FIG. 12.
Figure 12:
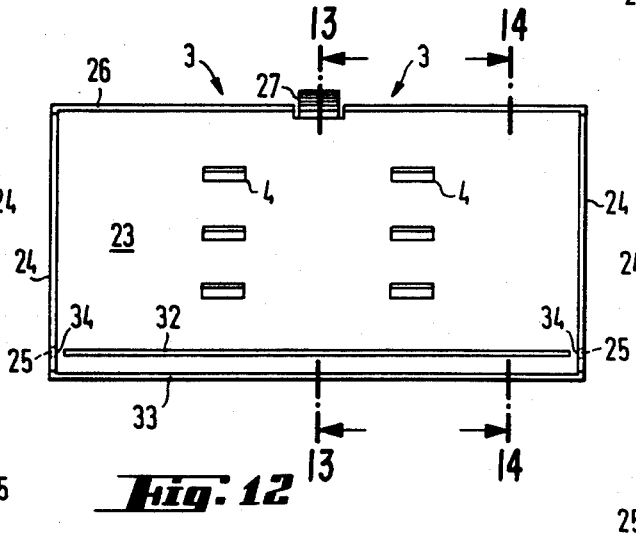
FIG. 12 is a general back plan view of the lid of the large middle compartment of the tidy element in accordance with the present invention.
Figure 13:
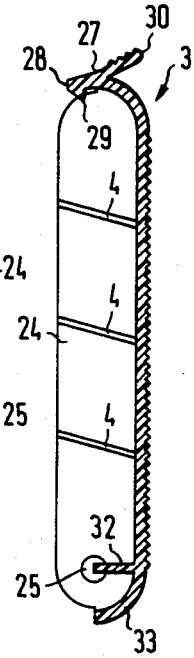
FIG. 13 is a cross-sectional side view taken on the line 13—13 of the FIG. 12.

FIGS. 12 to 14 illustrate the arrangement of the lid 3 of the compartment B that incorporates the following portions that are equivalent to the corresponding portions compartment A and are arranged in the same way as these corresponding portions (FIGS. 15, 18 and 19), a plane bottom portion indicated by the reference numeral 23, lateral portions indicated by the reference numeral 24 presenting at the lower end a hole indicated by the reference numeral 25 into which enters a trunnion or pivot 13 with which the lateral portions 12 of the main bottom part 6 are provided; a longitudinal upper porton indicated by the reference numeral 26, completing the longitudinal upper portions 14 of said main bottom part 6 comprising in its middle zone, partially cut away in order to make it more or less flexible, a plate indicated by the reference numeral 27, divided into two portions forming a small angle, one of which, portion 28, that protrudes inwardly and downwardly, is provided with a little downward lug indicated by the reference numeral 29 that may hook into the hooking rim 16 of the longitudinal portion 14 of the main bottom part 6, the other portion, indicated by the reference numeral 30, protruding upwardly and outwardly, constituting a gripping means; as the plate 27 is inclined and the portion 30 thereof follows an upward direction, when it is pulled downward, the portion 30 is lowered and the portion 28 is raised, whereby the lug 29 is freed. The lids 1 and 3 incorporate also each a longitudinal lower portion, the longitudinal lower portions of the lids 1 and 3 being rectilinear and in alignment, one of them, portion 31 (lid 1), located above the rotating axis (trunnion or pivot 13 and hole 25) of the lid constituting alone the lower portion of the compartment A and B, and the other one, portion indicated by the reference numeral 32 (lid 3), located on a level with the center line of said rotating axis, forming partially the lower portion of the compartment B, another portion indicated by the reference numeral 33 forming the lower end of the lid 1 and of the lid 3 respectively, extending only half part of the depth of the compartment A, or of the compartment B respectively, the edge of which, when the lid 1 or 3 is opened abutting against the longitudinal portion of the bottom of said portion 33, whereby the opening of said lids 1 and 3 is limited to 90°. In order that the trunnions or pivots 13 may enter the corresponding holes 25, the lateral faces 24 must be able to be bent slightly and to this end the longitudinal portion 32 does not extend in such a way as to be in contact with said lateral faces 24, but a little free space is left between each end of the longitudinal portion 32 and the opposite lateral face 24.

On the other hand, the lid 1, as seen in FIGS. 15 to 19, in the case of the embodiment illustrated by the drawings, is designed to receive a small lid 2, 2 presents the following particularities: the lateral portions 24 are provided with a forward portion indicated by the reference numeral 35 facing the recess 10 of the main bottom part 6 and the lower portion 31 is longer than the corresponding portion 32 of the lid 3 in order to cover the whole depth of the compartment A on this level; moreover, (FIG. 19), additionally to the free space 34, a cut away portion indicated by the reference numeral 36 is provided for positioning the small lid 2. On the other hand, the depth of the hole 25 is increased by a thickness indicated by the reference numeral 37 at the inner side.

Because of its particular use, the lid 3 is also provided with brackets 4, that are parallel and aligned in order to form rows of racks. Said brackets, as may be seen on FIG. 13, are inclined upward in order to be able to maintain the items supported thereon when the lid 3 is opened or closed. Said brackets 4 have a length that is approximately equal to the depth of the compartment B in order that the tidy element may be placed in all possible positions without modifying the position of the items placed on the racks.

FIGS. 20 to 23 illustrate the arrangement of the small lid 2 that is located in the lid 1. The small lid 2 comprises a plane rectangular portion indicated by the reference numeral 38, the length of which is equal to the length of lid 1 that it covers and the height of which is equal to the height of the recess 10 of the main bottom part 6. As it may be seen, the small lid 2 presents in the middle of its length a little upper cut away portion indicated by the reference numeral 39, that represents the preferential gripping zone for the opening of the small lid 2. At the lower side, the small lid 2 is provided with two small sides indicated by the reference numeral 40, that are perpendicular to the plane portion 38 and that are located in such a way as to be in contact with the forward portions 35 of the lid 1; at the outer face and at the upper part, said sides 40 are provided with a small projecting portions 41 forming a longitudinal flange that is designed to ensure clamping the small lid 2 and to maintain it in the closing position in the lid 1. Each side 40 extends and protrudes beyond the plane portion 38 downwardly and inwardly by a plate indicated by the reference numeral 42 provided with a small trunnion or pivot 43 that enters the corresponding hole 25 of the lateral portion 24 of the lid 1, thereby allowing the opening and the closing of the lid 2 with respect to the lid 1. It is to be noted that the small lid 2 is arranged in such a way that, when it is in the opening position, i.e. it is disengaged with respect to the lid 1, the latter being also in the opening position, if one closes entirely the lid 1, the lid 2 enters the lid 1 and will be maintained in the closed position due to the effect of the small protruding portions 41 when one will again open the lid 1. The small lid 2 forms, however only partially, a case and it is provided, only inwardly and at the lower end of the plane portion 38, with a longitudinal portion indicated by the reference numeral 44. For maintaining the lid 2 closed in the lid 1, it is provided that the longitudinal portion 44 forms at each end a rearwardly bent portion 45, the face 46 of which, parallel to side 41 is provided with a small projecting portion 47 forming a longitudinal flange that is designed to be pressure fitted above the edge of the cut away portion 36 of the lower portion of the lid 1; it would of course be possible to provide either only the two small projecting portions 41, or the two small projecting portion 47.

As may be seen on the drawings, the longitudinal upper side as well as the longitudinal lower sides of the main bottom part 6 and of the lids 1 and 3 are rounded and accordingly the end of the different lateral sides is of course rounded also. This is essentially to confer an aesthetic appearance to the tidy element, as is also the case of the longitudinal rounded portion indicated by the reference numeral 48 (FIG. 11) that is extends downward from the longitudinal lower portion 18 for the purpose of aesthetics only. Referring to FIG. 1, it will be seen that a plate bracket indicated by the reference numeral 49, that may be used for bearing a plate mentioning the trade mark or the name of the manufacturer, may be slid on the elastic strip 5.

Figure 24:
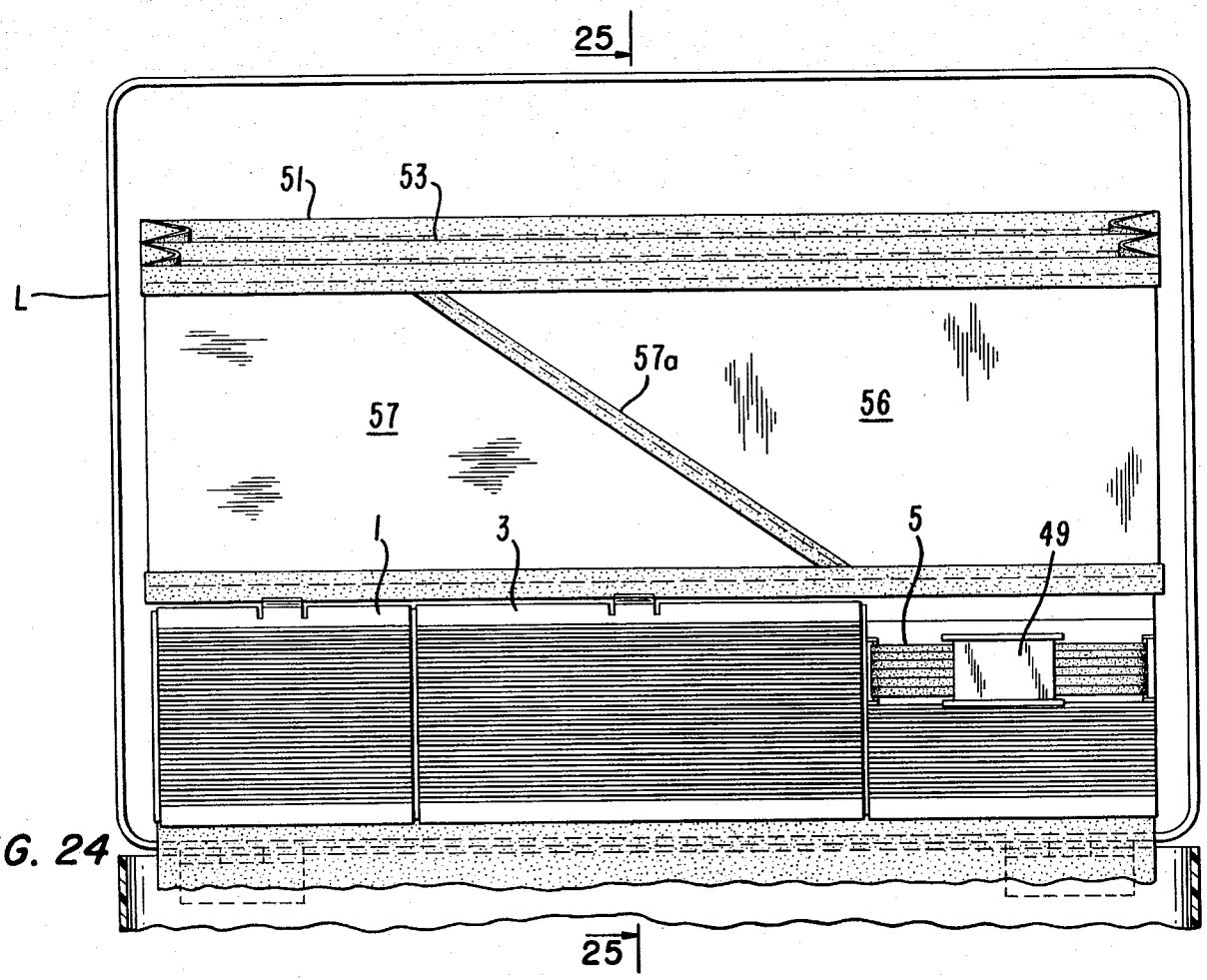
FIG. 24 is a front plan view of a tidy element installed in the lid of an attache case.
Figure 25:
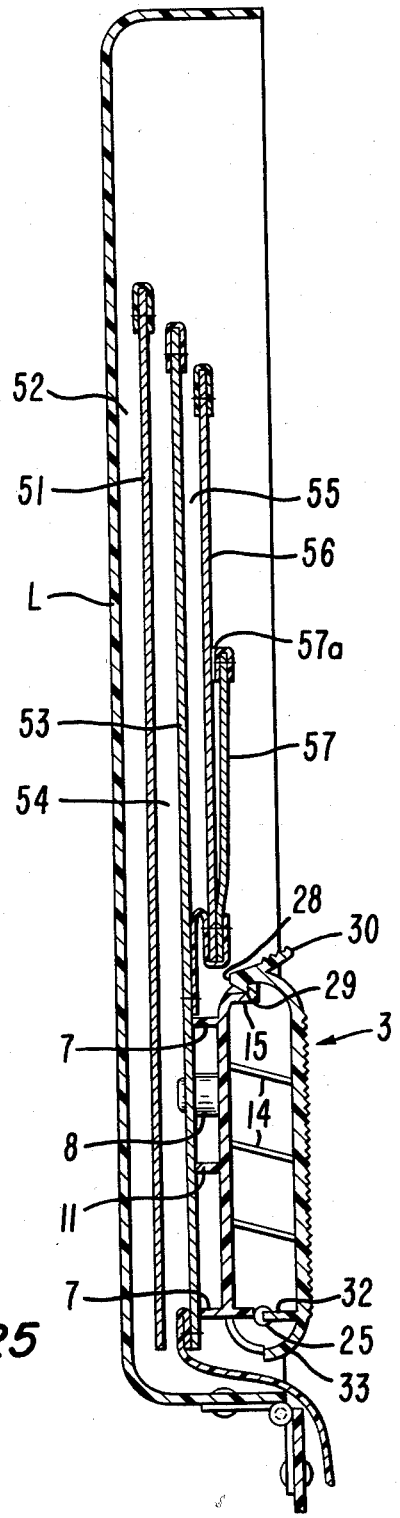
FIG. 25 is a cross-section taken on the line 25—25 in FIG. 24.

FIGS. 24 and 25 show by way of non-limiting example a tidy element in accordance with the invention installed in the lid L of an attache case in conjunction a portfolio 50 for holding various papers. The portfolio comprises a plurality of leaves or partitions forming a number of pockets. These are shown as including a partition 51 connected at its ends by flexible strips to the lid L to form a first pocket 52. A second partition 53 is connected at its ends by flexible strips to the partition 51 to form a second pocket 54. The pockets 52 and 54 have depth slightly less than the height of the lid (measure in a direction perpendicular to the hinge line of the lid) so as to leave sufficient space at the top for the insertion of papers into the pockets. The frame or base 7 of the tidy element is secured to a lower portion of the partition 53, for example by studs or rivets.

As will be seen in FIGS. 24 and 25 the tidy element has a length approximately equal to that of the lid but its height is only about one third the height of the lid. Above the tidy element, a third pocket 55 is provided by a third partition 56 attached to the partition 53 by flexible strips along its ends and lower edge. The depth of the pocket 55 is thus less than that of pockets 52 and 54 by an amount approximately equal to the height of the tidy element. A flap 57 secured along one end and lower and upper edges to the partition 56 and having a free inclinded edge 57*a* provides a pocket for holding small items such as plane or rail tickets. The partitions 51, 53, and 56 and flap 57 are conveniently formed in known manner of fabric-covered fiber board preferably provided on exposed edges with a leather or simulated leather binding. The flexible strips connecting the partitions are likewise formed of leather, simulated leather, or plastic material. As the base of the tidy element is reinforced by ribs 11 as described above, the tidy element has sufficient strength and ridigity even though it is attached to a somewhat flexible member i.e. the partition 53.

As will be seen from FIG. 25, the tidy element is relatively shallow so that it projects only slightly beyond the partition 56. For example it may have a depth of about 2.5 cm. Hence when the lid of the case is closed, the tidy element does not interfere with contents in the body of the case. At the same time, it provides room for holding numerous small items.

It will be understood that the portfolio may have more or fewer compartments as desired. Moreover, the portfolio may, if desired, be omitted whereupon the tidy element is secured directly to the lid of the case.

The present invention is not of course limited to the embodiment described and illustrated and it would not be outside the scope of the invention to amde detail modifications in presentation and form, for example, in providing the tidy element with a different number of compartments, in providing all the compartments or only one of them with a lid, etc.

I claim:

1. A tidy element comprising a substantially flat molded rectangular plastic base adapted to fit in the lid of a traveling case, means for securing said base in said case lid, said base having a bottom, top, sides and partitions dividing said base into a plurality of compartments, a molded lid for at least one of said compartments, said lid having a bottom, top and sides, means at sides of said lid for pivotally connecting said lid to said base to pivot about an axis spaced upwardly from the bottom of said lid, cooperating molded catch portions on the top of said base adapted to interengage with one another to secure said lid releasably in closed condition, molded release means on the top of said lid manually engageable to release said catch means and open said lid extending below the pivot axis of the lid and being engageable with the bottom of said base to limit the opening of said lid.

2. A tidy element according to claim 1, in which said pivotal connecting means comprises interengaging cooperating elements on said base and said lid, one of said elements comprising a stud and the other a hole receiving said stud.

3. A tidy element according to claim 1 in which said tidy element has a length slightly less than that of said lid, a height approximately one third that of the lid and a depth of about 2 to 3 cm.

4. A tidy element according to claim 1 in which there are three of said compartments, of which only two compartments have lids.

5. A tidy element according to claim 4, in which one of said compartments with lids is longer than the other.

6. A tidy element according to claim 4, in which said compartment without a lid is provided with elastic strap means for holding an article in said compartment.

7. A tidy element according to claim 1, in which a lid of one compartment has a small compartment therein and a small hinged inner lid for closing said small compartment.

8. A tidy element according to claim 1, in which a lid of one compartment has on its inner face brackets for holding elongated articles.

* * * * *